US011035113B2

(12) United States Patent
Eftekharzadeh

(10) Patent No.: US 11,035,113 B2
(45) Date of Patent: Jun. 15, 2021

(54) UTILIZING DEBRIS BASINS FOR STORMWATER RETENTION

(71) Applicant: Shahriar Eftekharzadeh, Torrance, CA (US)

(72) Inventor: Shahriar Eftekharzadeh, Torrance, CA (US)

( * ) Notice: Subject to any disclaimer, the term of this patent is extended or adjusted under 35 U.S.C. 154(b) by 0 days.

(21) Appl. No.: 16/852,444

(22) Filed: Apr. 18, 2020

(65) Prior Publication Data

US 2020/0240129 A1 Jul. 30, 2020

(51) Int. Cl.

*E03F 5/10* (2006.01)
*E03F 5/12* (2006.01)
*E03F 1/00* (2006.01)

(52) U.S. Cl.

CPC ..... *E03F 5/125* (2013.01); *E03F 1/00* (2013.01); *E03F 1/002* (2013.01); *E03F 5/102* (2013.01); *E03F 5/105* (2013.01)

(58) Field of Classification Search

CPC ..... E03F 1/00; E03F 5/10; E03F 5/102; E03F 5/103; E03F 5/105; E03F 5/106; E03F 5/125; E03F 7/02; E02B 5/08; E02B 8/06; E03B 3/02; E03B 3/04

USPC ..... 210/747.2, 747.3, 747.9, 163, 170.01, 210/170.03, 170.09; 405/39, 40, 41, 42, 405/108, 118

See application file for complete search history.

(56) References Cited

U.S. PATENT DOCUMENTS

| | | | | | |
|---|---|---|---|---|---|
| 3,962,084 | A * | 6/1976 | Nussbaum | E03F 5/105 | 210/747.2 |
| 4,838,732 | A * | 6/1989 | Clark | E03F 7/02 | 210/163 |
| 5,174,897 | A * | 12/1992 | Wengrzynek | C02F 3/327 | 210/170.09 |
| 6,077,423 | A * | 6/2000 | Roy | E03F 5/105 | 210/170.03 |
| 6,416,674 | B1 * | 7/2002 | Singleton | E03F 5/105 | 210/163 |
| 7,108,783 | B2 * | 9/2006 | Glazik | E03F 1/00 | 210/170.03 |
| 7,473,373 | B1 * | 1/2009 | Danler | E03F 1/00 | 210/170.03 |
| 8,545,696 | B2 * | 10/2013 | Tyner | E03F 1/00 | 210/170.03 |
| 9,279,225 | B1 * | 3/2016 | Prokupek | E03F 5/105 | |
| 9,962,638 | B1 * | 5/2018 | Tucker | B01D 35/02 | |
| 2002/0044835 | A1 * | 4/2002 | Esposito | E03B 3/04 | 405/80 |
| 2010/0300981 | A1 * | 12/2010 | Albers | B01D 21/0093 | 210/747.2 |

* cited by examiner

*Primary Examiner* — Christopher Upton

(57) ABSTRACT

Utilizing debris basins for stormwater retention.

1 Claim, 2 Drawing Sheets

UTILIZING DEBRIS BASINS FOR STORMWATER RETENTION

FIELD OF THE INVENTION

The present invention is in the field of devices for storing water. More specifically, the present invention relates to storage of water in basins.

BACKGROUND OF THE INVENTION

Debris basins are facilities used to protect urban storm drain system by trapping of sediment and debris transported during wet-weather events by normally dry open channels. Typically, they consist of a small earthen dam across the channel equipped with an overflow spillway, which creates an open basin for storage of trapped sediment and debris up to a certain design elevation. Debris basins are intended only for trapping of sediment and debris and are deliberately designed not to retain water. They incorporate a permanently open inlet structure that is typically either a perforated riser pipe, a drop-inlet concrete box, or both, collectively "riser', connected to an outlet conduit through the dam that passes the incoming flow downstream. During dry weather, any incoming flow passes unrestricted through an opening at the base of the riser pipe. During wet weather, water builds up in the basin and outflow occurs per the discharge rating curve characteristics of the riser and overflow spillway. Following the wet weather event, the riser freely drains the basin dry.

Recent environmental needs and regulations are mandating the retention, treatment, and beneficial utilization of stormwater runoff. This is as an imperative driven by regulations to prevent and mitigate pollution and the need to augment diminishing water resources because of water scarcity exacerbated by climate change. The volume of the stormwater runoff is often very large requiring large retention facilities that require extensive land hard to find in most urban areas. This makes the storage volume available at debris basin a valuable resource for water retention if it can be accommodated without affecting their primary function of sediment and debris entrapment.

Therefore, there is a need for operating existing and future debris basins in a manner that utilizes their significant storage space for stormwater retention without affecting their primary function of sediment and debris entrapment.

SUMMARY OF THE INVENTION

The present invention provides a solution to the above need by making a simple modification to the standard design of debris basin outlet works that enables the basin to also retain water.

As noted, current debris basin outlet works design incorporates a riser with an orifice opening at the base to pass dry weather flows. Wet weather flows in excess of the orifice capacity raise the water level in the basin causing increased outflow as the water level reaches the perforation levels in the riser. As inflow continues to increase beyond the capacity of the perforations, the water level in the basin reaches the top of the riser, which allows inflow through a trash rack, resulting in further outflow capacity. Further increase in inflow beyond the capacity of the riser causes the water level in the basin to rise to the invert level of an overflow spillway that is designed to have adequate capacity to safely pass the largest inflow to the basin.

Once the wet weather inflow reduces, spillway flow ceases and outflow from the basin continues through the riser at a gradually decreasing rate as the water level in the basin drops to the basin floor level. The debris basin is thus left void of any water inside after the wet weather event, ready for the next wet weather event. The deposited sediment and debris are cleaned out periodically based on a predetermined operation and maintenance protocol that maintains certain storage volume in the basin.

The present invention has been conceived by the realization that there is no real functional necessity for the above described configuration of the debris basin outlet works, which is designed not to retain any water in the basin. The current design is justified based on operation simplicity, which provides a self-draining facility where water retention is not a purpose, and hence unwanted. So, the current design makes perfect sense from this perspective. However, with changing needs and requirement, stormwater retention is now a much needed and sought after purpose, which can be fulfilled by expanding the utilization of debris basins to also retain and store stormwater. Indeed, adding water retention as a purpose to debris basins increases the efficiency of sediment and debris entrapment of the basin through enhanced deposition.

It is an object of the present invention to incorporate stormwater retention as a purpose and requirement in the operation of existing and future basins by means of simple and readily constructible modifications, without negatively impacting the primary function of sediment and debris entrapment of debris basins.

It is an object of this invention to provide improved elements and arrangements by apparatus for the purposes described thereof, which is comparable in cost with existing systems, dependable, and fully effective in accomplishing its intended purposes.

These and other objects of the present invention will become readily apparent upon further review of the following specification and drawings.

DETAILED DESCRIPTION

Figure 1:
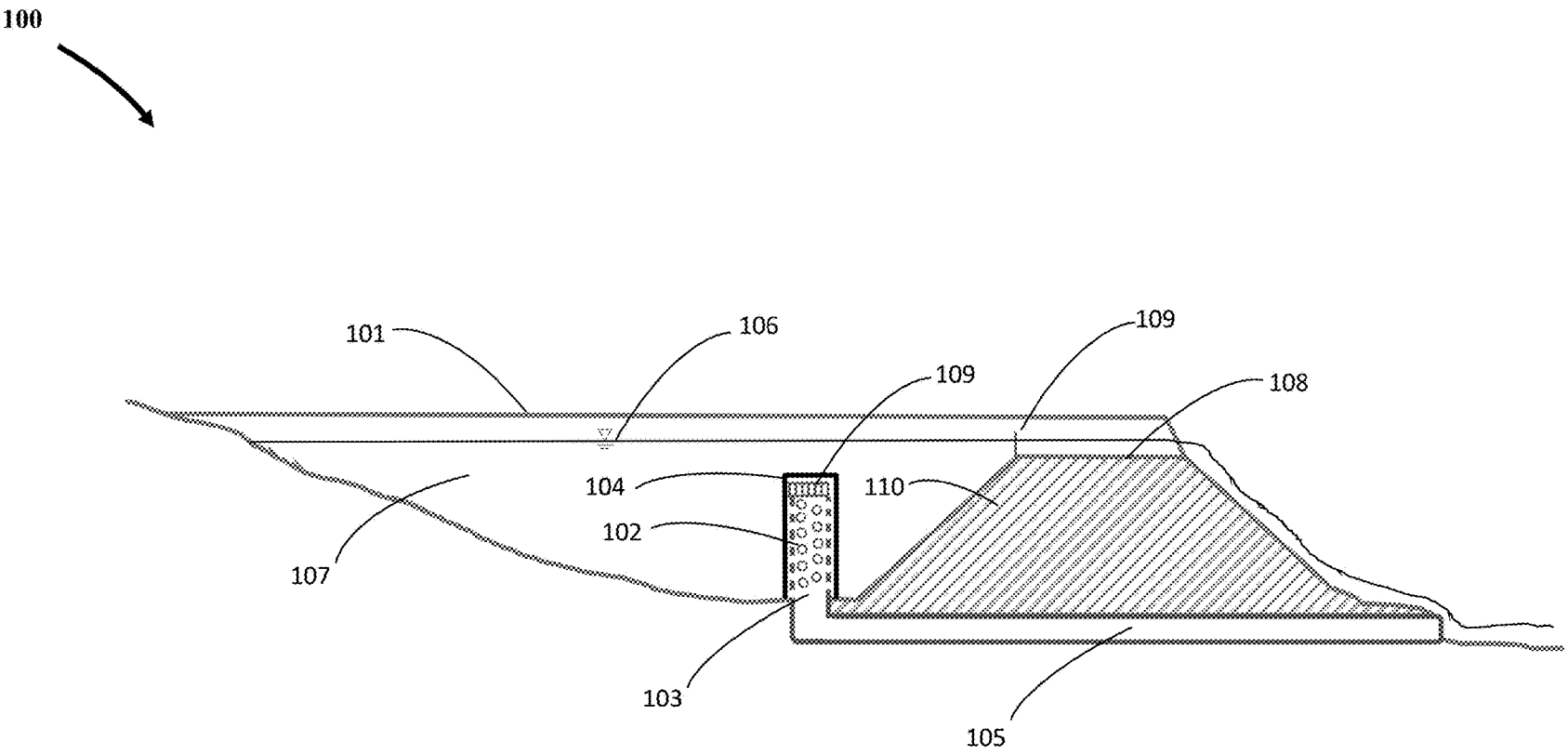
FIG. 1 is cross section through a debris basin showing one embodiment of the present invention.

Referring to FIG. 1, there is shown one embodiment of the present invention 100 in debris basin 101 where riser 103 is covered over with impermeable cover 104 closing off all openings 102 and trash rack 109 atop riser 103 such that there is no outflow through riser 103 via conduit 105. Embodiment 100 of the present invention disables gravity outflow from interior of debris basin 101 through conduit 105 such that outflow can only occur when level 106 of water 107 in debris basin 101 rises above invert level of spillway 108 atop dam 110, which may be fitted with trash rack 109 to capture floating debris. With embodiment 100 of the present invention, removal of retained water 107 from debris basin 101 requires other means, not shown. These may include pumping for transfer to higher elevations or siphonage for transfer to lower elevations.

Embodiment 100 of the present invention captures all inflow to basin 101, both during both dry and wet weather times, until level 106 of water 107 reaches invert level of spillway 108. Stored water 107 may be removed by said means prior to a forecast wet-weather event to enable capture of inflowing water from that event. However, removal of water 107 from debris basin 101 prior to a wet weather event is not a necessity for functioning of debris basin 101 to entrap sediment and debris. This is because incoming sediment and debris will deposit and displace water 107 retained inside basin 101 regardless. Water 107 is pushed out of basin 101 over spillway 108 if basin 101 is full of water 107. Removal of retained water 107 from debris basin 101 by said means is only necessary to save stored water 107 and to restore capability of basin 101 to retain additional water.

Figure 2:
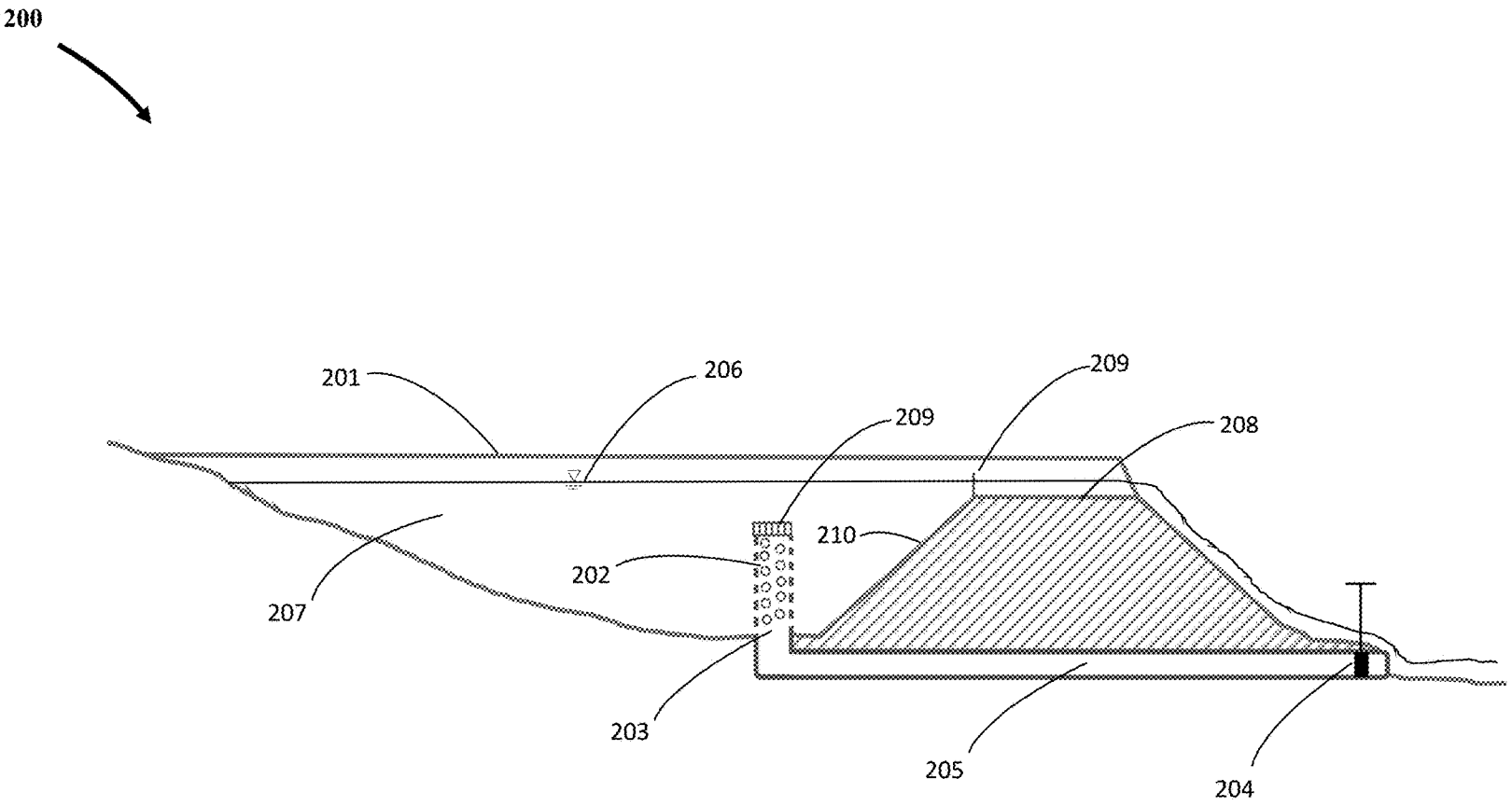
FIG. 2 is cross section through a debris basin showing another embodiment of the present invention.

Referring to FIG. 2, there is shown another embodiment of the present invention 200 in debris basin 201 where openings 22 in riser 2023 and trash rack 209 atop riser 23 are provided to enable flow through riser 203 via conduit 205. Conduit 205 is fitted with flow control device 204 capable of shutting off flow through conduit 205 either completely or partially. Flow control device 204 may be located at a variety of locations in conduit 205, including at inlet, outlet, or anywhere in between, and can take a variety of shapes and forms including but not limited to lift gate, valve, or stop logs. Embodiment 200 of the present invention can fully shut off gravity outflow from interior of debris basin 201 through conduit 205 such that outflow can only occur when level 206 of water 207 in debris basin 201 rises above invert level of spillway 208 atop dam 210, which may be fitted with trash rack 209 to capture floating debris. With embodiment 200 of the present invention, removal of retained water 206 from debris basin 201 can be achieved by opening flow control device 204, either partially or fully, when desired.

Embodiment 200 of the present invention provides operational flexibility for debris basin 201 with regards to timing and quantify of inflow water captured in debris basin 201. For example, the operator may decide to keep flow control device 204 open during dry weather flows if so desired and only capture wet weather flow, or vice versa. Embodiment 200 of the present invention also has the advantage of not requiring additional means for gravity flow of retained water 207 downstream.

The present invention is susceptible to modifications and variations which may be introduced thereto without departing from the inventive concepts and the object of the invention. Various other means of restricting and/or shutting off flow in riser and conduit may be employed to accomplish the stated object of the present invention, which is to utilize debris for water retention in addition to entrapment of sediment and debris. Such means fall within the object of the present invention.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A method for utilizing debris basins for stormwater retention, the method comprising:

an open channel disposed to convey stormwater;

a debris basin across said open channel comprising a dam equipped with an overflow spillway, at least one inlet structure upstream of said dam, and at least one outlet pipe;

enclosure around and atop said inlet structure(s) disposed to prevent water from entering said structure(s) and inlet pipe(s);

Means of removal of water retained from interior of said debris basin.

* * * * *